US011371802B2

(12) United States Patent
Liao

(10) Patent No.: US 11,371,802 B2
(45) Date of Patent: Jun. 28, 2022

(54) HANDGUARD QUICK DISMANTLING STRUCTURE OF TOY GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 15 days.

(21) Appl. No.: 17/165,959

(22) Filed: Feb. 3, 2021

(65) Prior Publication Data

US 2022/0042765 A1 Feb. 10, 2022

(30) Foreign Application Priority Data

Aug. 7, 2020 (TW) ..... 109210227

(51) Int. Cl.
*F41C 23/16* (2006.01)
*F41A 21/48* (2006.01)
*F41C 3/00* (2006.01)

(52) U.S. Cl.
CPC ..... *F41C 23/16* (2013.01); *F41A 21/48* (2013.01); *F41C 3/005* (2013.01)

(58) Field of Classification Search
CPC ..... F41C 23/16; F41C 3/005; F41C 27/00; F41A 21/48; F41A 3/66; F41A 11/02; F41B 11/89; F41G 11/003
USPC ... 42/71.01, 72, 75.02, 90, 75.01, 94, 75.03, 42/73; 89/191.01
See application file for complete search history.

(56) References Cited

U.S. PATENT DOCUMENTS 7,627,975 B1 * 12/2009 Hines ..... F41G 11/003 42/84
8,667,726 B1 * 3/2014 Huff ..... F41G 11/003 42/71.01
8,931,201 B2 * 1/2015 Gianladis ..... F41A 23/18 42/94
9,032,659 B1 * 5/2015 Duneman ..... F41C 27/00 42/71.01
2015/0241166 A1 * 8/2015 Hines ..... F41G 11/003 42/75.02
2016/0091272 A1 * 3/2016 Hines ..... F41C 23/16 42/90
2016/0169610 A1 * 6/2016 Hines ..... F41A 35/02 42/90

(Continued)

*Primary Examiner* — Michael D David
(74) *Attorney, Agent, or Firm* — Leong C. Lei

(57) ABSTRACT

A handguard quick dismantling structure is provided for a toy gun and includes a barrel portion that has a barrel pivoting portion, a handguard portion that has a handguard pivoting portion, a barrel retaining piece including a barrel connecting portion and barrel coupling portion respectively arranged at opposite locations, and a handguard retaining piece including a handguard connecting portion and a handguard coupling portion respectively arranged at opposite ends. The handguard retaining piece is such that when the handguard portion and the barrel portion are combined, the handguard coupling portion is in coupling engagement with and fixed to the barrel coupling portion, and when the handguard portion and the barrel portion are separated, the handguard coupling portion is disengageble from the barrel coupling portion to achieve an effect of quick dismantling of the handguard.

8 Claims, 8 Drawing Sheets

(56) References Cited

U.S. PATENT DOCUMENTS

| | | | | |
|---|---|---|---|---|
| 2017/0097207 | A1* | 4/2017 | Hines | F41C 23/16 |
| 2020/0109912 | A1* | 4/2020 | Parra | F41C 23/16 |

* cited by examiner

HANDGUARD QUICK DISMANTLING STRUCTURE OF TOY GUN

TECHNICAL FIELD OF THE INVENTION

The present invention relates to a toy gun, and more particularly to a handguard quick dismantling structure of a toy gun that allows a handguard of the toy gun to be quickly dismantled and replaced.

DESCRIPTION OF THE PRIOR ART

A toy gun is a necessary piece of equipment for people taking part in a survival game. Early-day toy guns are generally structured for simply shooting, and do not provide simulation of real shooting. The players are now demanding reality simulation in order to experience combating in a real battle field. The toy guns must include a structure of handguard. The purpose of the handguard is simply shrouding a barrel of the toy gun in order to provide protection to the user and to allow the user to securely grip and hold the barrel of the toy gun to improve shooting accuracy.

In playing a survival game, a user may need to take certain violent actions, such as swinging the toy gun while turning or rolling. This may cause impact with external objects, and consequently, the handguard of the toy gun may get damaged or broken due to the impact. The user has to replace the handguard after the combating game.

There are certain problems to replace the handguard for the known toy guns.

To replace the handguard of the known toy gun, since the handguard is fixed with a handguard retention ring and an upper barrel by means of bolts or screws, the user who attempts to change the handguard must employ tools to engage and rotate the screw in order to remove the handguard for replacement. On the whole, this is tedious. In case that no tool is available, this means no removal of the handguard is possible. This is disadvantageous to convenience of use.

SUMMARY OF THE INVENTION

The primary objective of the present invention is that by pivotally connecting a barrel pivoting portion and a barrel connecting portion and pivotally connecting a handguard pivoting portion and a handguard connecting portion to allow a barrel portion and a handguard portion to be mutually retained and fixed by using a barrel retaining piece and a handguard retaining piece so as to achieve quick combination and separation, without using any tool, and thus it is possible to greatly enhance replacement time, cost, and convenience.

The structure that the present invention adopts to achieve the above objective comprises a barrel portion. The barrel portion comprises a barrel pivoting portion. A handguard portion is arranged on the barrel portion. The handguard portion comprises a handguard pivoting portion. Further, the barrel pivoting portion is pivotally connected with a barrel connecting portion. The barrel connecting portion is arranged at an end of a barrel retaining piece. The barrel retaining piece is provided, at an end distant from the barrel connecting portion, with a barrel coupling portion. Further, the handguard pivoting portion is pivotally connected with a handguard connecting portion. The handguard connecting portion is arranged at one end of a handguard retaining piece. The handguard retaining piece is provided, at an opposite end, with a handguard coupling portion.

With the above structure, in attempting to remove or dismantle the handguard portion from the toy gun, the muser may first push or move the barrel retaining piece, such that the barrel connecting portion of the barrel retaining piece is caused to rotate relative to the barrel pivoting portion. During the course of rotating downward, the coupling between the barrel coupling portion and the handguard coupling portion causes the handguard retaining piece to rotate, about a rotation center defined by the handguard connecting portion, in a downward direction until reaching a predetermined extent of angular displacement by which the coupling condition between the barrel coupling portion and the handguard coupling portion is released, and thus allowing the handguard portion to be detached from the barrel portion for replacement. Oppositely, to mount the handguard portion, the user set the handguard portion to engage with the barrel portion, so that the handguard retaining piece is located in front of the barrel retaining piece. Under such a condition, the user may push the barrel retaining piece upward and during the course of upward pushing, the handguard coupling portion is set into coupling engagement with the barrel coupling portion. Under such a condition, the user may continuously push the barrel retaining piece until the coupling engagement site of the barrel coupling portion and the handguard coupling portion is located higher than a level height of the barrel connecting portion and the handguard connecting portion to thereby complete the coupling engagement operation.

Based on the above technology, the problem for replacement of a prior art toy gun handguard structure that the handguard is fastened by screws to fix the handguard, a handguard retention ring, and the upper barrel together and a user, for the purpose of replacing the handguard, has to use a tool to engage the screw for rotating and removing in order to dismantle the handguard for replacement, which, on the whole, is a tedious operation and would make it impossible to dismantle the handguard in case of no tool being available, can be overcome in order to achieve the advantage of the present invention as stated herein.

DETAILED DESCRIPTION OF THE PREFERRED EMBODIMENT

Figure 1:
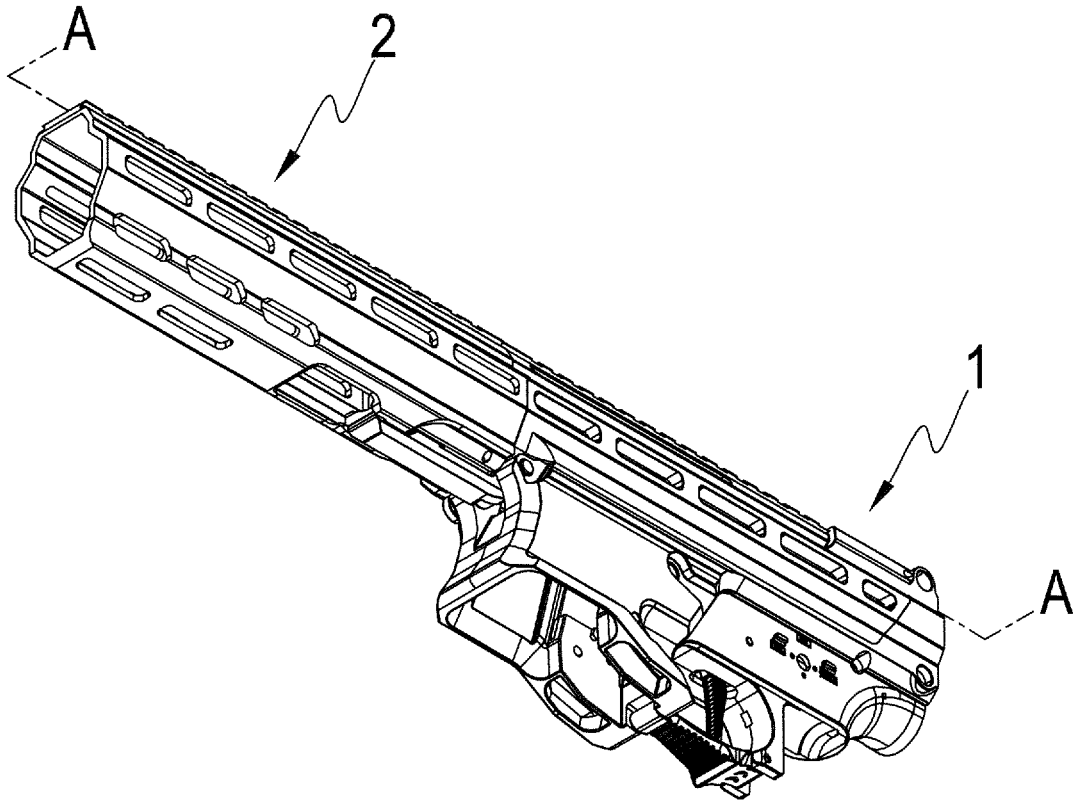
FIG. 1 is a perspective view, taken from a lower side, showing a toy gun according to the present invention, with a stock and a magazine removed.
Figure 2:
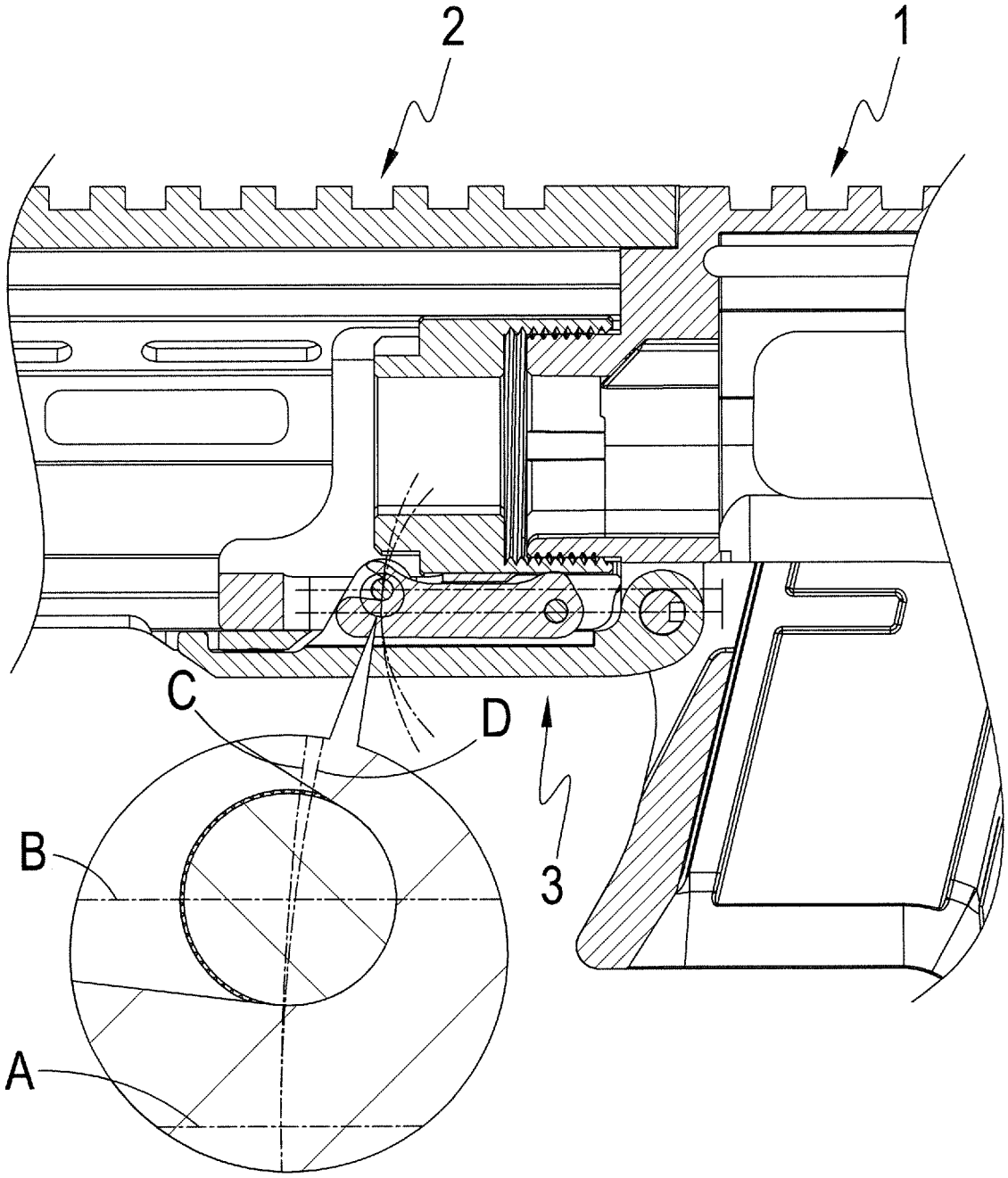
FIG. 2 is a cross-sectional view of the present invention, taken along line A-A of FIG. 1.
Figure 3:
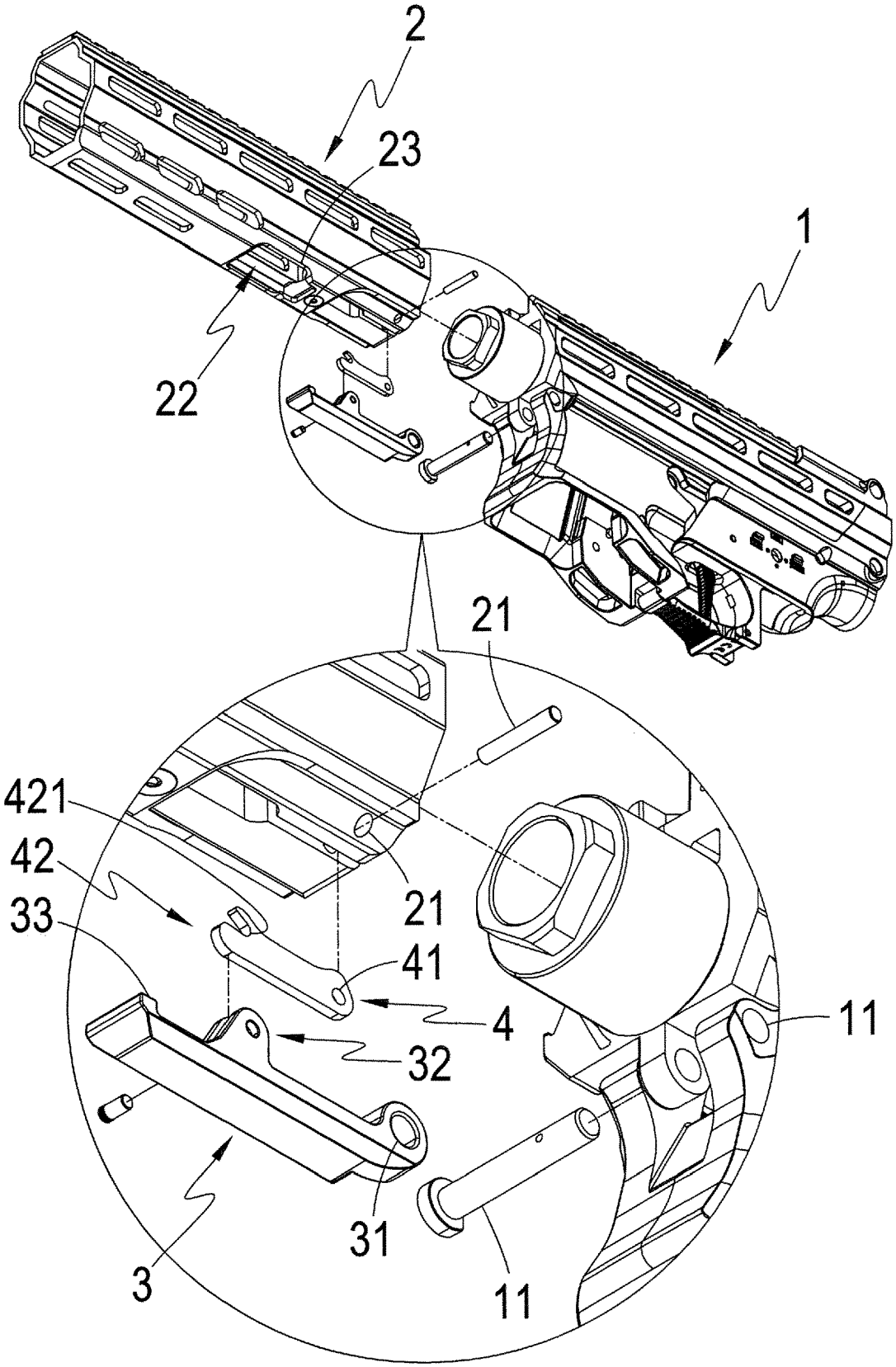
FIG. 3 is an exploded view showing a preferred embodiment of the present invention.
Figure 4:
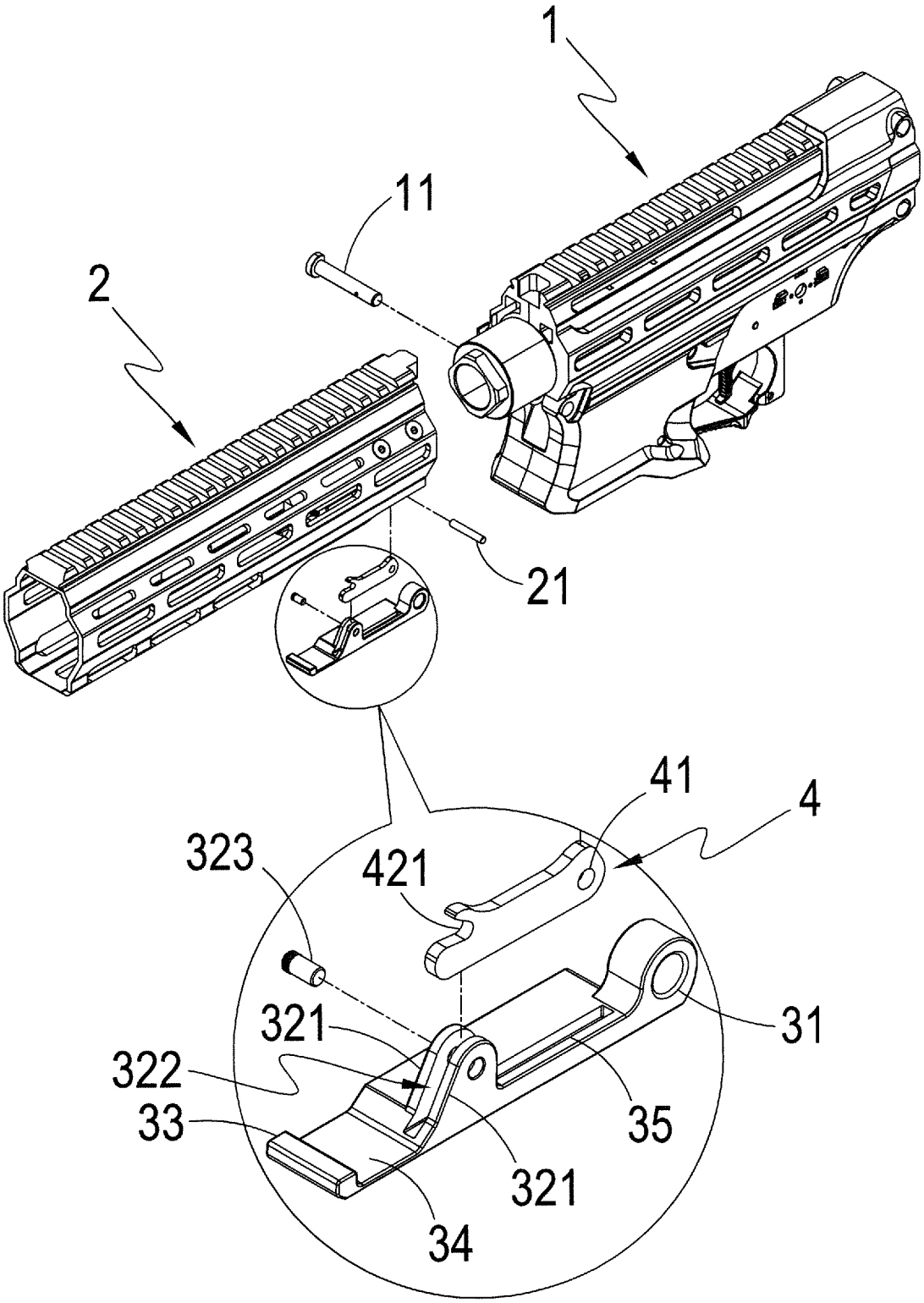
FIG. 4 is an exploded view, taken from a different angle, showing the preferred embodiment of the present invention.
Figure 5:
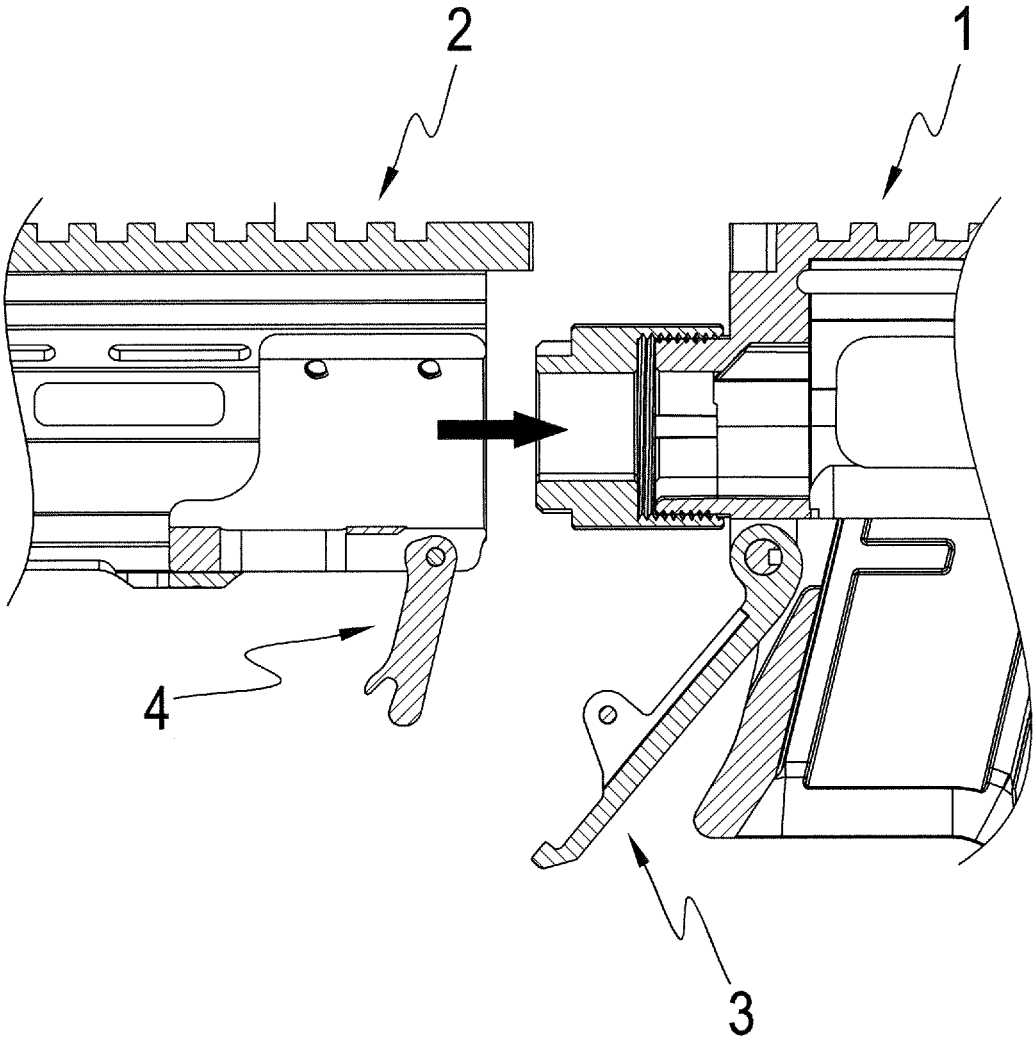
FIG. 5 is a first schematic view, in a partially enlarged form, illustrating mounting of a handguard according to the present invention.

Referring to FIGS. 1-4, which are respectively a perspective view, taken from a lower side, showing a toy gun according to the present invention, with a stock and a magazine removed; a cross-sectional view of the present invention, taken along line A-A of FIG. 1; an exploded view showing a preferred embodiment of the present invention; and an exploded view, taken from a different angle, showing the preferred embodiment of the present invention, it can be clearly seen from the drawings that the present invention comprises:

a barrel portion 1, which comprises a barrel pivoting portion 11;

a handguard portion 2, which is arranged on the barrel portion 1, the handguard portion 2 comprising a handguard pivoting portion 21, the handguard portion 2 having a bottom that is formed with a handguard receiving space 22 for receiving and holding a pushing portion 33 that will be described hereinafter therein, the handguard receiving space 22 having a side in which a through opening 23 is formed;

a barrel retaining piece 3, which has an end that includes a barrel connecting portion 31 movably and pivotally connected to the barrel pivoting portion 11 and comprises a barrel coupling portion 32 arranged at a location distant from the barrel connecting portion 31, the barrel retaining piece 3 comprising a pushing portion 33 arranged at an end of the barrel coupling portion 32 that is opposite to the barrel connecting portion 31, a horizontal contacting portion 34 being arranged between the barrel coupling portion 32 and the pushing portion 33, the barrel coupling portion 32 having two wall portions 321, the two wall portions 321 defining a retaining space 322 therebetween, a retaining bar 323 being arranged between the two wall portions 321 and having two ends respectively connected to the wall portions 321; and a handguard retaining piece 4, which has an end that includes a handguard connecting portion 41 movably and pivotally connected to the handguard pivoting portion 21 and an opposite end that includes a handguard coupling portion 42, the handguard coupling portion 42 being formed with a recessed notch 421, the recessed notch 421 being receivable in the retaining space 322 and mutually engageable with the retaining bar 323;

wherein the barrel retaining piece 3 comprises a channel 35 that is formed between the barrel connecting portion 31 and the two wall portions 321 and is in communication with the retaining space 322.

For an operation that can be achieved with the above components, when the handguard portion 2 and the barrel portion 1 are combined, the handguard retaining piece 4 is such that the handguard coupling portion 42 is set in retaining engagement with and coupled to the barrel coupling portion 32, and when the handguard portion 2 and the barrel portion 1 are detached from each other, the handguard coupling portion 42 is disengageable from and separated from the barrel coupling portion 32.

Referring to FIGS. 2-8, which are respectively a cross-sectional view of the present invention, taken along line A-A of FIG. 1; an exploded view showing a preferred embodiment of the present invention; an exploded view, taken from a different angle, showing the preferred embodiment of the present invention; and first to fourth schematic views, each in a partially enlarged form, illustrating mounting of the handguard according to the present invention, it can be clearly seen from the drawings that, in the instant embodiment, the barrel pivoting portion 11 and the handguard pivoting portion 21 are arranged, as an example of illustration, as a through hole in collaborative combination with a pivot pin, and the barrel connecting portion 31 and the handguard connecting portion 41 are each arranged, as an example of illustration, as a through hole that is fit over and pivotally coupled to the pivot pin. Further, the barrel coupling portion 32 and the handguard coupling portion 42 are coupled to be in retaining engagement with each other at a location that is higher than a level height of the barrel connecting portion 31 and the handguard connecting portion 41. Concerning more details regarding the retaining engagement location, reference is made to FIG. 2, where the barrel pivoting portion 11 and the handguard pivoting portion 21 are set at the same level height. By taking this horizontal reference line A as a reference point, in a state where the barrel retaining piece 3 is moved upward to be thus retained and fixed, and the horizontal contacting portion 34 is in contact with the bottom of the handguard portion 2, the level location at which the barrel coupling portion 32 and the handguard coupling portion 42 are coupled (the horizontal reference line B) is higher than the horizontal reference line A, and further, the barrel retaining piece 3 has a moving path of which a rotation radius is indicated by a movement reference line C and the handguard retaining piece 4 has a moving path of which a rotation radius is indicated by a movement reference line D.

Figure 6:
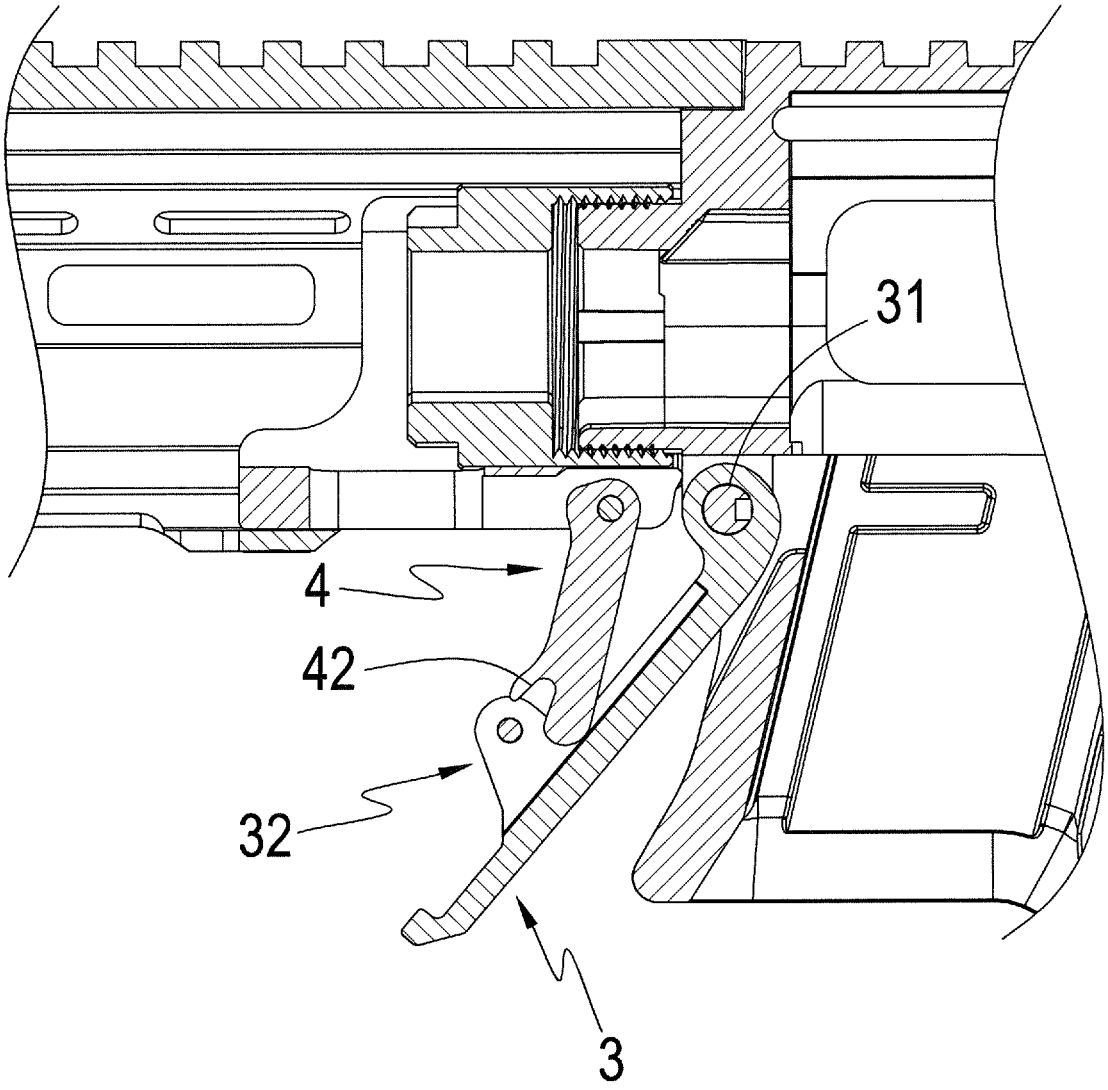
FIG. 6 is a second schematic view, in a partially enlarged form, illustrating mounting of the handguard according to the present invention.
Figure 7:
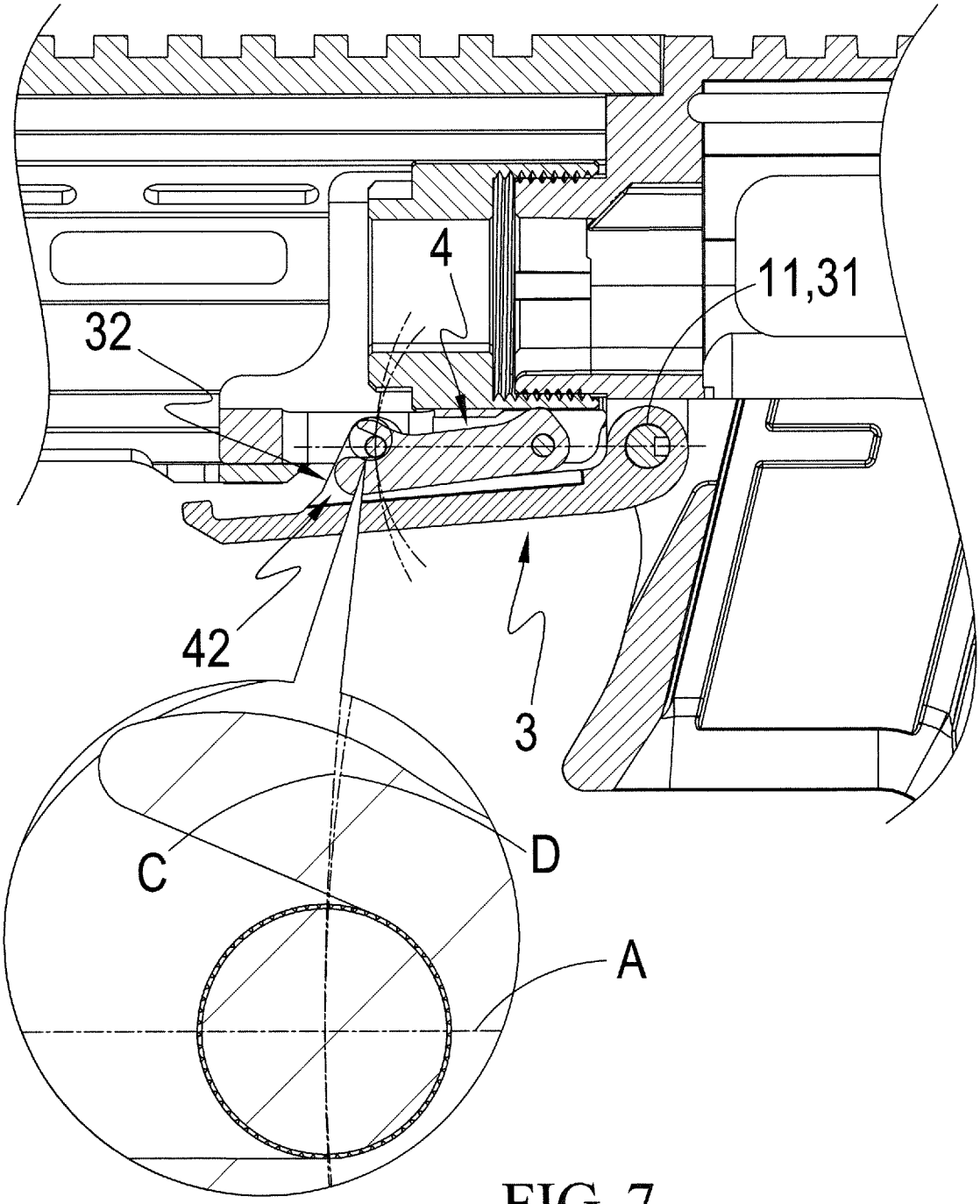
FIG. 7 is a third schematic view, in a partially enlarged form, illustrating mounting of the handguard according to the present invention.
Figure 8:
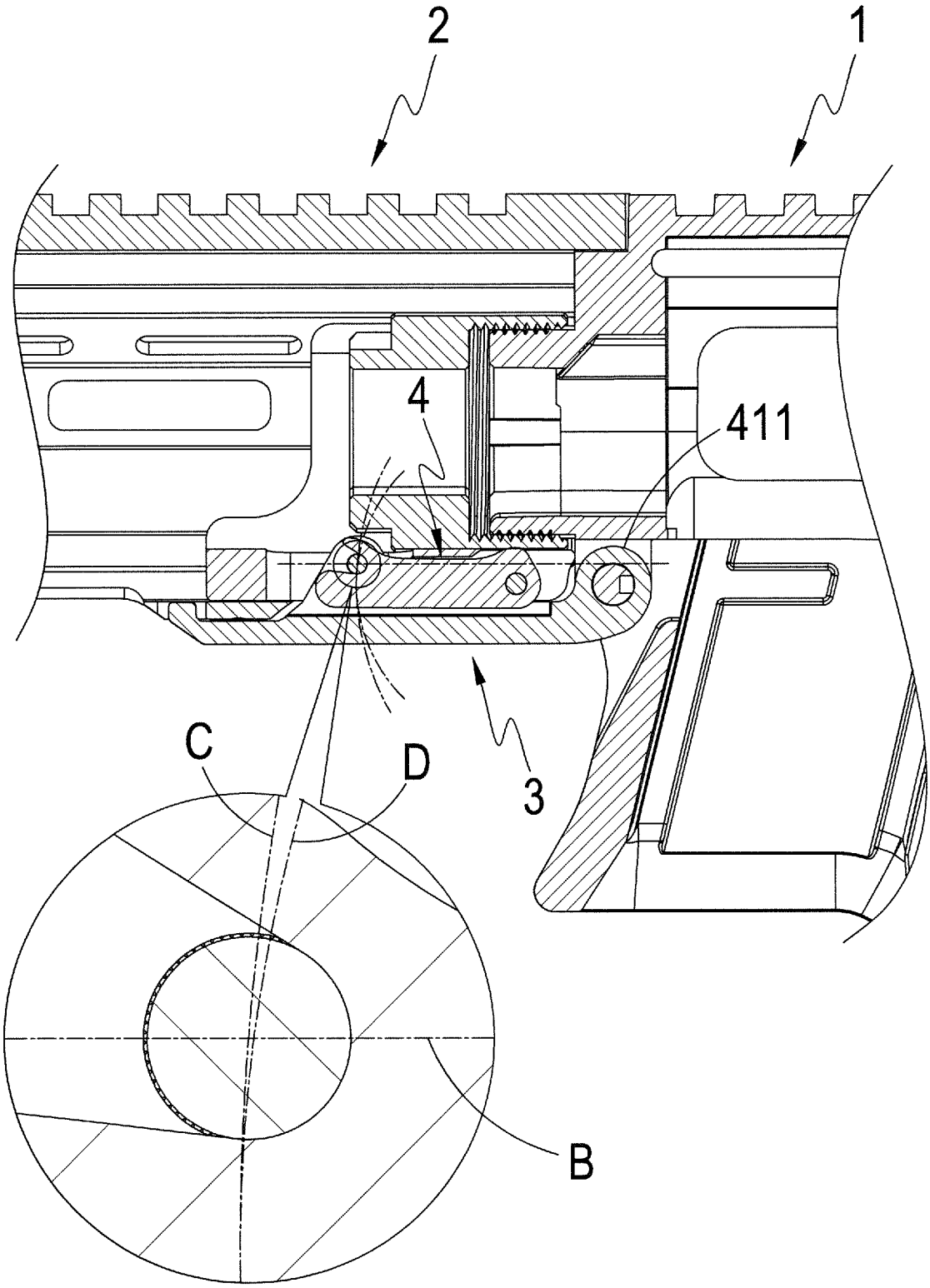
FIG. 8 is a fourth schematic view, in a partially enlarged form, illustrating mounting of the handguard according to the present invention.

When a user attempts to mount the handguard portion 2, since the handguard connecting portion 41 and the handguard pivoting portion 21 are set in a pivotally coupled condition, the handguard retaining piece 4 is allowed to freely move. When the handguard portion 2 is moved rearward to engage and contact the barrel portion 1, as shown in FIG. 6, the handguard retaining piece 4 is at a location adjacent to one side of the barrel retaining piece 3, and the handguard coupling portion 42 is at a location between the barrel connecting portion 31 and the barrel coupling portion 32. Afterwards, the barrel retaining piece 3 is rotated upward about a rotation center defined by the barrel connecting portion 31 and the barrel pivoting portion 11, such that during the course of rotation, the barrel coupling portion 32 and the handguard coupling portion 42 are coupled to each other and the recessed notch 421 is received into the retaining space 322 formed between the two wall portions 321 to get into retaining engagement and coupled with the retaining bar 323, until the position as shown in FIG. 7 is reached, where the handguard retaining piece 4 is partly moved into the channel 35. The barrel coupling portion 32 is rotating upward according to the movement reference line C and the handguard coupling portion 42 is rotating upward according to the movement reference line D to reach a condition of being parallel with the horizontal reference line A, and since the movement reference line C and the movement reference line D generate an overlapping condition, which indicates a most tightly retained position between the barrel coupling portion 32 and the handguard coupling portion 42, such that further pushing upwards would bring the barrel coupling portion 32 and the handguard coupling portion 42 to the location of the horizontal reference line B. Under such a condition, since the distance between the movement reference line C and the handguard pivoting portion 21 is slightly greater than a distance between the movement reference line D and the handguard pivoting portion 21, and a relatively loosened condition is achieved. As such, the coupled and secured configuration of the barrel retaining piece 3 and the handguard retaining piece 4 is achieved to thereby fix the handguard portion 2 to the barrel portion 1. In addition, the handguard connecting portion 41 is provided, at one side thereof, with a the tightening portion 411, so that the barrel retaining piece 3 and the handguard retaining piece 4 achieving the coupled and secured configuration allows the tightening portion 411 to abut and press against the lower part of the barrel portion 1 to strengthen the retained and secured configuration, realizing a two-level securing arrangement, which helps prevent the barrel retaining piece 3 and the handguard retaining piece 4 from separation.

On the other hand, a user attempting to dismantle the handguard portion 2 may uses fingers to grip the sides of the barrel retaining piece 3 or may insert the fingers through the through opening 23 into the handguard receiving space 22 to move the pushing portion 33. In the instant embodiment, pushing the pushing portion 33 to move the barrel retaining piece 3 is taken as an example for illustration. Then, the barrel retaining piece 3 can be directly pushed downward to release the coupled and secured state between the barrel coupling portion 32 and the handguard coupling portion 42, so as to achieve the purpose of quick dismantling.

Thus, referring to all the drawings attached, use of the present invention provides the following advantages as compared to the prior art:

Firstly, the collaborative combination between the barrel retaining piece 3 and the handguard retaining piece 4 achieves an effect of realizing fast mounting of the handguard portion 2 with a minimized and simplest structure.

Secondly, the retaining engagement location between the barrel coupling portion 32 and the handguard coupling portion 42 being set higher than the level height of the barrel connecting portion 31 and the handguard connecting portion 41 achieves an effect of securing and retaining without any additional retaining technology.

Thirdly, dismantling of the handguard portion 2 or mounting of the handguard portion 2 can be done easily and conveniently as the dismantling and mounting can be carried out without any assisting tool.

I claim:

1. A toy gun handguard quick dismantling structure, mainly comprising:

a barrel portion, which comprises a barrel pivoting portion;

a handguard portion, which is arranged on the barrel portion, the handguard portion comprising a handguard pivoting portion;

a barrel retaining piece, which has an end comprising a barrel connecting portion pivotally mounted to the barrel pivoting portion, and comprises a barrel coupling portion at a location distant from the barrel connecting portion; and a handguard retaining piece, which has an end comprising a handguard connecting portion pivotally mounted to the handguard pivoting portion and an opposite end comprising a handguard coupling portion, wherein the handguard retaining piece is structured such that when the handguard portion and the barrel portion are combined, the handguard coupling portion is set in retaining engagement with and coupled to the barrel coupling portion, and when the handguard portion and the barrel portion are separated, the handguard coupling portion disengages from the barrel coupling portion, and wherein a location of coupling engagement between the barrel coupling portion and the handguard coupling portion is higher than a level height of the barrel connecting portion and the handguard connecting portion.

2. The toy gun handguard quick dismantling structure according to claim 1, wherein the barrel retaining piece comprises a pushing portion arranged at an end of the barrel coupling portion that is opposite to the barrel connecting portion.

3. The toy gun handguard quick dismantling structure according to claim 2, wherein the handguard portion comprises a bottom that is formed with a handguard receiving space in which the pushing portion is receivable, the handguard receiving space having a side in which a through opening is formed.

4. The toy gun handguard quick dismantling structure according to claim 2, wherein the barrel retaining piece comprises a horizontal contacting portion between the barrel coupling portion and the pushing portion.

5. The toy gun handguard quick dismantling structure according to claim 1, wherein the barrel coupling portion includes two wall portions, the two wall portions defining therebetween a retaining space, a retaining bar being provided between the two wall portions and having two ends respectively connected to the wall portions.

6. The toy gun handguard quick dismantling structure according to claim 5, wherein the handguard coupling portion is formed with a recessed notch, the recessed notch being receivable in the retaining space and engageable with the retaining bar.

7. The toy gun handguard quick dismantling structure according to claim 5, wherein the barrel retaining piece comprises a channel formed between the barrel connecting portion and the two wall portions and in communication with the retaining space.

8. The toy gun handguard quick dismantling structure according to claim 1, wherein the handguard connecting portion is provided, at one side thereof, with a tightening portion that is engageable with and abutting a lower part of the barrel portion.

* * * * *